US007578771B1

(12) United States Patent
Towley, III et al.

(10) Patent No.: US 7,578,771 B1
(45) Date of Patent: Aug. 25, 2009

(54) WEIGHT SELECTION AND ADJUSTMENT SYSTEM FOR SELECTORIZED DUMBBELLS INCLUDING MOTORIZED SELECTOR POSITIONING

(75) Inventors: Carl K. Towley, III, Alexandria, MN (US); Gregory S. Olson, Owatonna, MN (US)

(73) Assignee: Intellex, Inc., Owatonna, MN (US)

( * ) Notice: Subject to any disclaimer, the term of this patent is extended or adjusted under 35 U.S.C. 154(b) by 28 days.

(21) Appl. No.: 11/999,742

(22) Filed: Dec. 6, 2007

Related U.S. Application Data

(60) Provisional application No. 60/873,681, filed on Dec. 8, 2006.

(51) Int. Cl.
*A63B 21/072* (2006.01)
*A63B 21/075* (2006.01)

(52) U.S. Cl. ..... 482/106; 482/5; 482/104; 482/108

(58) Field of Classification Search ..... 482/5, 482/93, 94, 104, 106–108, 908
See application file for complete search history.

(56) References Cited

U.S. PATENT DOCUMENTS

| | | | | |
|---|---|---|---|---|
| 4,529,198 | A * | 7/1985 | Hettick, Jr. | 482/104 |
| 4,720,099 | A * | 1/1988 | Carlson | 482/133 |
| 5,769,762 | A * | 6/1998 | Towley et al. | 482/93 |
| 6,039,679 | A * | 3/2000 | Yu | 482/110 |
| 7,264,578 | B1 * | 9/2007 | Krull | 482/108 |
| 2003/0148862 | A1 * | 8/2003 | Chen et al. | 482/108 |

* cited by examiner

*Primary Examiner*—Fenn C Mathew
*Assistant Examiner*—Andrew M Tecco
(74) *Attorney, Agent, or Firm*—James W. Miller

(57) ABSTRACT

A weight selection and adjustment system for a selectorized dumbbell comprises a stand that holds a pair of selectorized dumbbells. The stand has an electric motor that is selectively energized by a controller for substantially simultaneously adjusting the weight of both dumbbells. The controller is responsive to a weight selection made by a user through a data entry device. The system can also be used with a single dumbbell placed on the stand. Alternatively, the electric motor can be mounted on the handle of a selectorized dumbbell to allow weight adjustment operations to be made without placing the selectorized dumbbell on a stand. In this embodiment, the data entry device and controller can also be carried on the handle of each selectorized dumbbell.

20 Claims, 16 Drawing Sheets

WEIGHT SELECTION AND ADJUSTMENT SYSTEM FOR SELECTORIZED DUMBBELLS INCLUDING MOTORIZED SELECTOR POSITIONING

CROSS REFERENCE TO RELATED APPLICATIONS

This application claims the benefit of one or more previously filed copending provisional applications identified as follows: Application Ser. No. 60/873,681 filed Dec. 8, 2006.

TECHNICAL FIELD

This invention relates generally to exercise equipment. More particularly, this invention relates to selectorized dumbbells and to an overall, integrated system for selecting and adjusting the weight of a selectorized dumbbell or a pair of selectorized dumbbells.

BACKGROUND OF THE INVENTION

Selectorized dumbbells overcome the cost and space obstacles presented by traditional dumbbells. In a selectorized dumbbell, a plurality of weights nest together. The weights provide a stack of nested left weight plates and a stack of nested right weight plates. The left and right stacks of weight plates are separated from one another by a gap.

In a selectorized dumbbell, a handle is inserted into the gap between the left and right stacks of weight plates. A selector is then manipulated to determine how many of the left and right weight plates of the weights are coupled to the left and right ends of the handle. Once the selector is positioned to pick up a selected number of weights, the handle can then be lifted by the user from between the stacks of weight plates. The selected number of weights will rise with the handle to be used in performing various exercises with the dumbbell.

While selectorized dumbbells represent a major advance in exercise equipment, the selectors used to adjust the weight of the dumbbell are mechanical members that must be directly gripped and manipulated by the user. A well known selectorized dumbbell is shown in U.S. Pat. No. 5,769,762, owned by the assignee of this invention. In the dumbbell shown in the 762 patent, the selector comprises a connecting pin that is manually inserted by the user into different locations on the handle to vary the number of weights connected to the handle. Other selectorized dumbbells use other types of mechanical selectors, such as rotatable shafts, knobs, or the like.

With mechanical and user positionable selectors, there is always the possibility that the user might not fully or correctly engage the selector. If this were to occur, one or more weights might inadvertently detach from the handle while the dumbbell is in use. This poses a risk of injury to the user or a risk of damage to the dumbbell. Obviously, this is a disadvantage.

Moreover, many exercises that a typical user might perform require the joint use of a pair of dumbbells. The weight of each dumbbell must be individually set or adjusted. In other words, the user first has to adjust the selector on one of the dumbbells to whatever weight is desired. Then, the user must repeat the procedure for the second dumbbell by adjusting the selector of the second dumbbell. The user must take care to see that the selectors on the two dumbbells are identically positioned to provide the same weight on each dumbbell. Given the small increments of adjusting movement in some known selectors, the user must pay close attention when moving the selector to make sure the proper amount of weight has been selected.

Finally, many people today are quite familiar with electronic devices in which data entry is accomplished by the manipulation of an alpha-numeric keyboard or a numeric keypad or the like. Such data entry devices are found on a host of products such as personal computers, cell phones, television remote controls, etc. Yet, no similar data entry device has been used to adjust the numbers of weights coupled to each end of the handle of a selectorized dumbbell. There is a need in the art to automate and ease the task of adjusting the weight of selectorized dumbbells.

SUMMARY OF THE INVENTION

One aspect of this invention relates to a weight selection and adjustment system for a selectorized dumbbell. The system includes a selectorized dumbbell that comprises a stack of nested left weight plates and a stack of nested right weight plates, a handle having a left end and a right end, and a movable selector having a plurality of different adjustment positions in which the selector may be disposed. The selector is configured to couple selected numbers of left weight plates to the left end of the handle and selected numbers of right weight plates to the right end of the handle with the selected numbers of coupled weight plates differing depending upon the adjustment position in which the selector is disposed, thereby allowing a user to select for use a desired exercise weight to be provided by the selectorized dumbbell. An electric motor is operatively connected to the selector at least whenever a weight adjustment operation takes place. The electric motor when energized from a source of electric power physically moves the selector into the adjustment position corresponding to the desired exercise weight that was selected for use by the user.

Another aspect of this invention relates to a weight selection and adjustment system for a selectorized dumbbell. The system includes a selectorized dumbbell that comprises a stack of nested left weight plates and a stack of nested right weight plates, a handle having a left end and a right end, and a movable selector having a plurality of different adjustment positions in which the selector may be disposed. The selector is configured to couple selected numbers of left weight plates to the left end of the handle and selected numbers of right weight plates to the right end of the handle with the selected numbers of coupled weight plates differing depending upon the adjustment position in which the selector is disposed, thereby allowing a user to select for use a desired exercise weight to be provided by the selectorized dumbbell. A means selectively actuable by the user is provided for adjusting the exercise weight of each dumbbell without requiring the user to physically contact and move the selector himself or herself.

Yet another aspect of this invention relates to a weight selection and adjustment system for a dumbbell. The system includes dumbbell that provides an exercise weight that is lifted by a user when the user grips and lifts a handle of the dumbbell. The exercise weight provided by the dumbbell is adjustable by coupling more or fewer weight plates to each end of the handle. An electric motor is provided that may be selectively energized and when energized will cause a desired number of weight plates to be coupled to each end of the handle. A data entry device is provided to allow the user to input a weight selection decision that operatively controls the energization of the motor to adjust the exercise weight of the dumbbell in accordance with the weight selection decision input into the data entry device by the user.

An additional aspect of this invention comprises a weight selection and adjustment system for a dumbbell. The system includes a stand. A pair of dumbbells are supported on the stand during a weight adjustment operation. Each dumbbell provides an exercise weight that is lifted by a user when the user grips and lifts a handle of the dumbbell. The exercise weight provided by each dumbbell is adjustable by coupling more or fewer weight plates to each end of the handle. A single operator is provided that is selectively actuated by a user from a position remote from the dumbbells for substantially simultaneously adjusting the exercise weight of both dumbbells as the dumbbells are supported on the stand.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

One embodiment of a weight selection and adjustment system according to this invention is illustrated as 2. System 2 includes a support stand 4 for holding a pair of selectorized dumbbells 6. Stand 4 stores dumbbells 4 when they are not in use. In addition, dumbbells 4 are placed on stand 4 to adjust the overall weight of each dumbbell.

Figure 1:
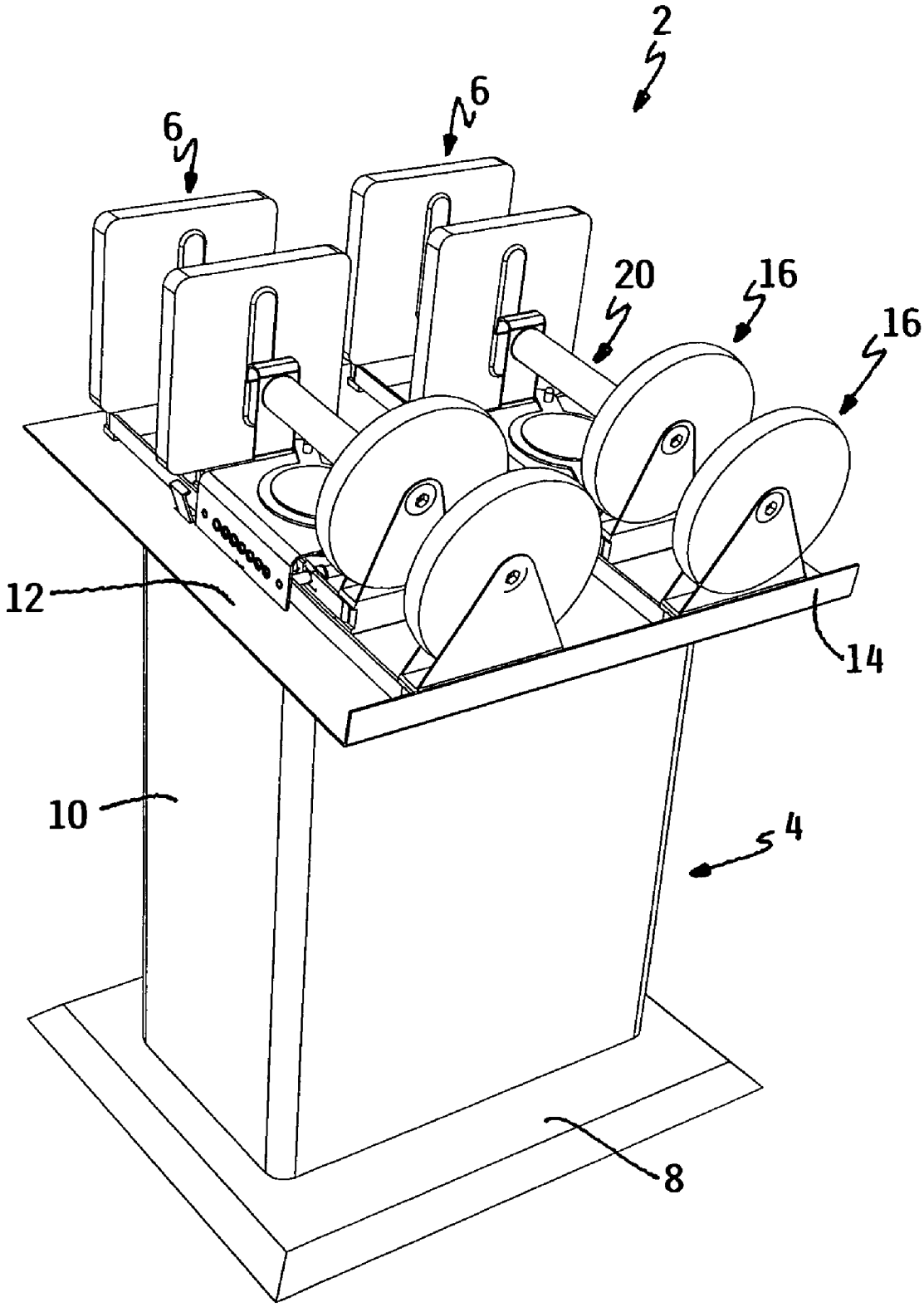
FIG. 1 is a perspective view of a first embodiment of a weight selection and adjustment system for selectorized dumbbells according to this invention, particularly illustrating a system used to adjust the weight of a pair of selectorized dumbbells that are placed atop a support stand.

Stand 4 includes a base 8 for supporting stand 4 on the floor, a vertical column or post 10 attached to base 8 and extending upwardly therefrom, and an upwardly facing support tray 12 atop column or post 10. The pair of selectorized dumbbells 6 are laid on top of the upper surface of support tray 12 as shown in FIG. 1. Support tray 12 slants downwardly from the back towards the front and the front edge of support tray 12 includes an upturned lip 14. Lip 14 prevents dumbbells 4 from sliding off support tray 12 of stand 4 when dumbbells 4 are positioned thereon.

Selectorized dumbbells 4 are identical to one another. Accordingly, a description of one dumbbell will serve to describe the other. Selectorized dumbbells 4 are similar to those shown in the assignee's prior U.S. Pat. No. 5,769,762, which is hereby incorporated by reference.

Figure 2:
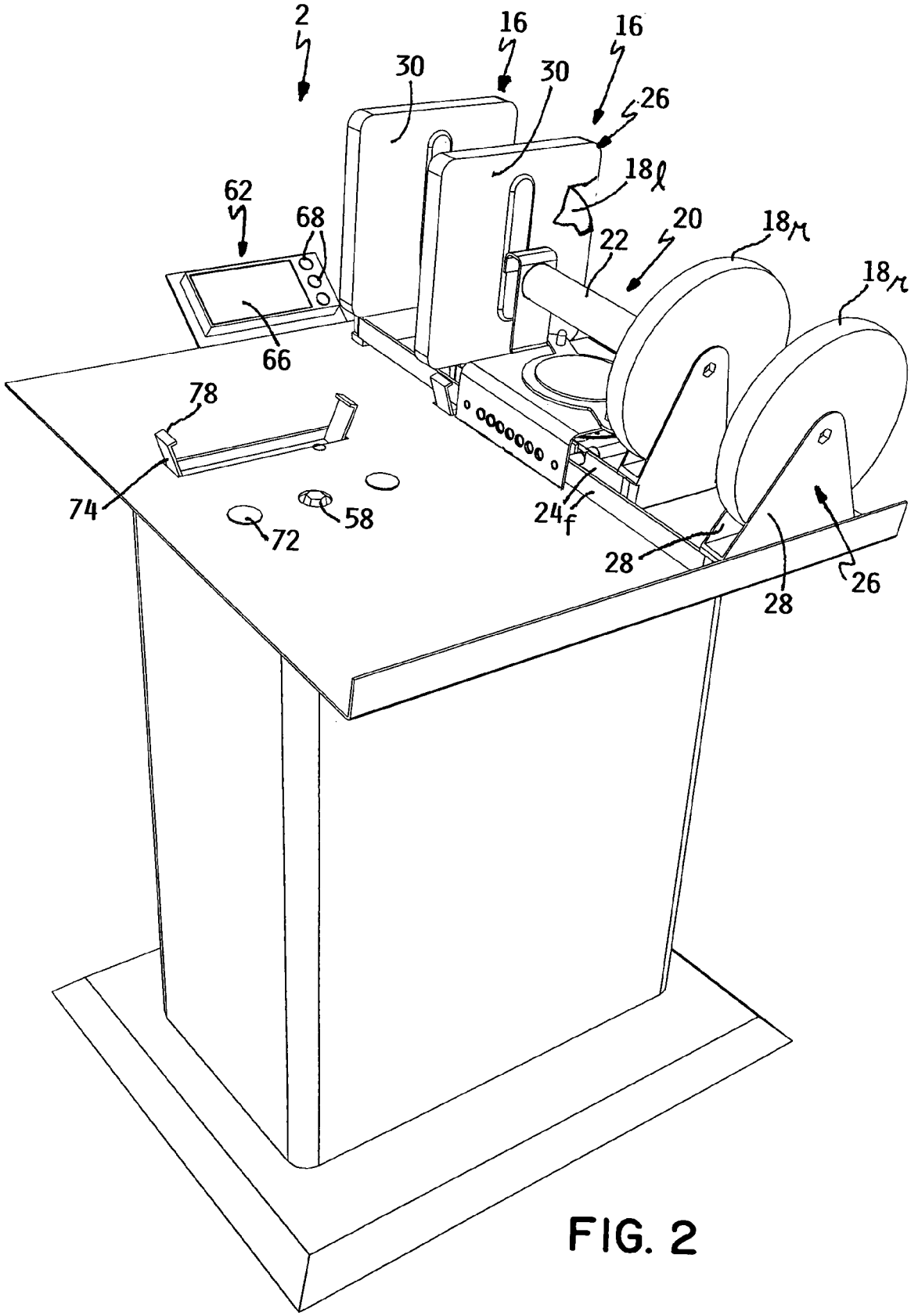
FIG. 2 is a perspective view similar to FIG. 1, but illustrating one of the selectorized dumbbells entirely removed from the stand to show the mechanical interlock fingers that project through the support tray of the stand as well as the electrical interlock sensors and the powered rotatable driver for rotating the selector of the dumbbell.
Figure 3:
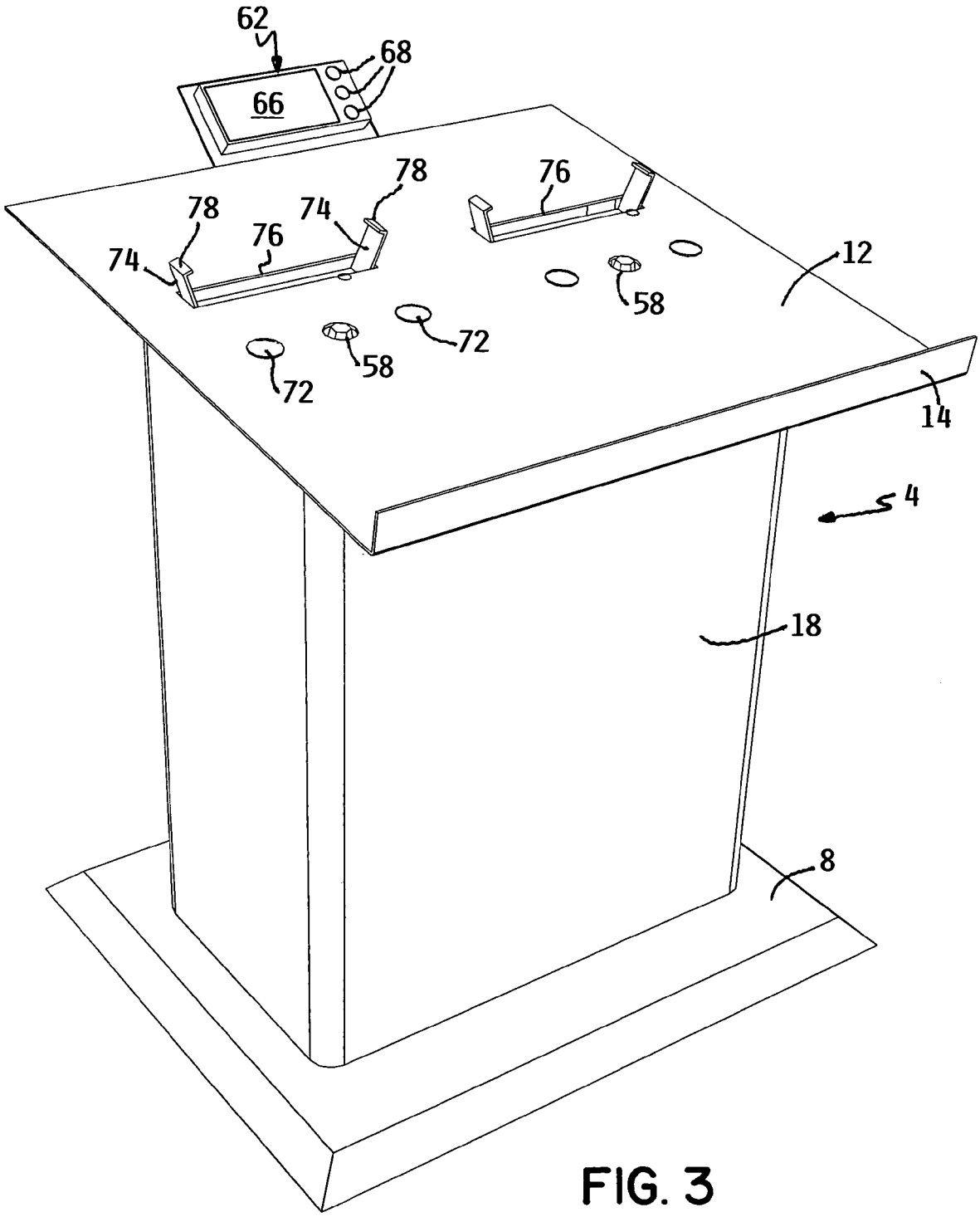
FIG. 3 is a perspective view similar to FIG. 2, but illustrating both of the selectorized dumbbells removed from the stand.

As is true for all selectorized dumbbells 4, each dumbbell includes a plurality of weights 16 that provide two nested stacks of weight plates 18. The stacks of weight plates 18 are separated by a gap into which the handle 20 of dumbbell 4 may be inserted. Handle 20 includes a handgrip 22 that extends perpendicularly relative to weight plates 18 when handle 20 is dropped down into the gap. For reference purposes, the stacks of weight plates will be referred to as a stack of nested left weight plates $\mathbf{18}_l$ adjacent a left end of handle 20 and a stack of nested right weight plates $\mathbf{18}_r$ adjacent a right end of handle 20. See FIG. 2.

Figure 4:
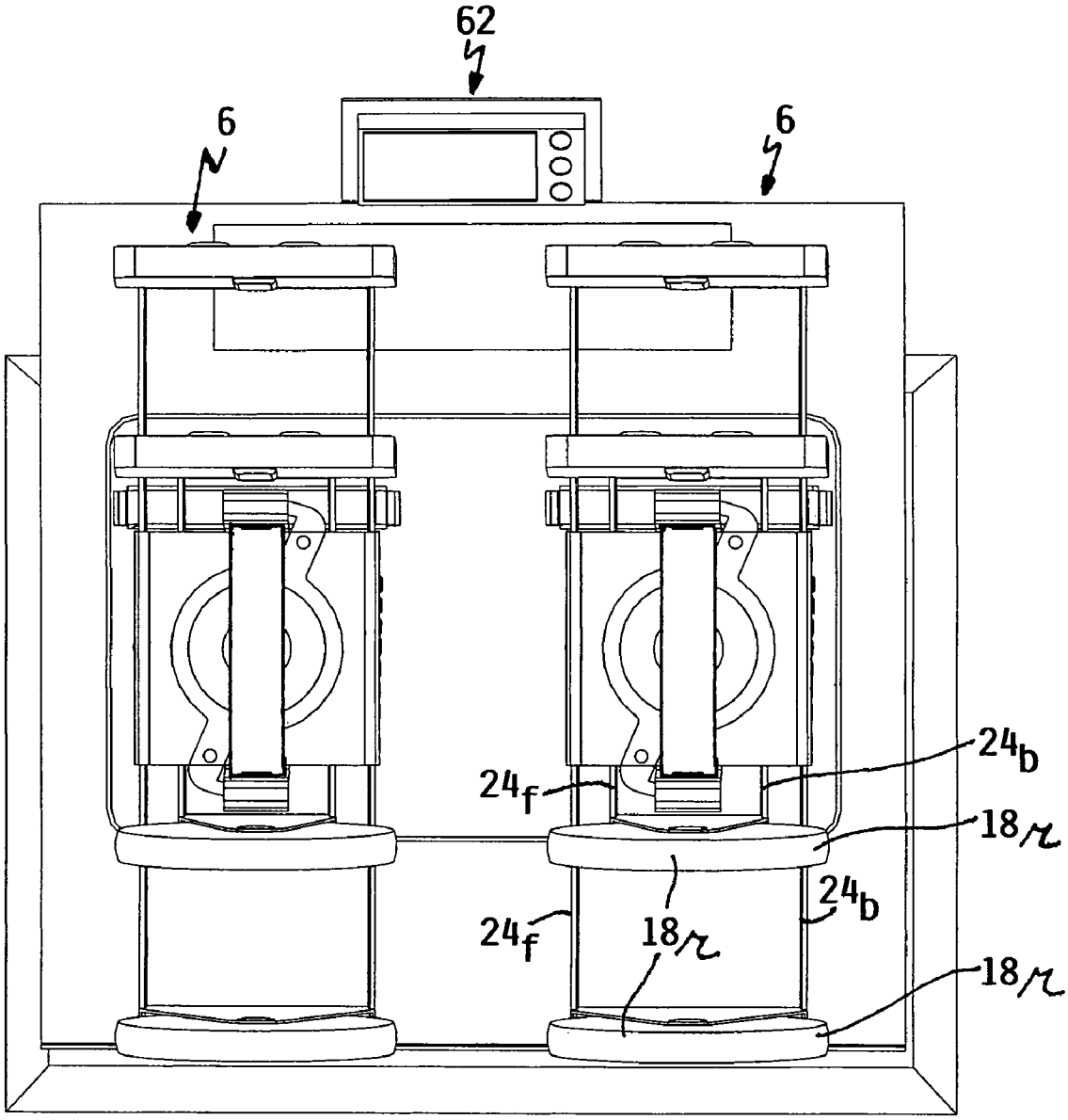
FIG. 4 is a top plan view of the system of FIG. 1.
Figure 5:
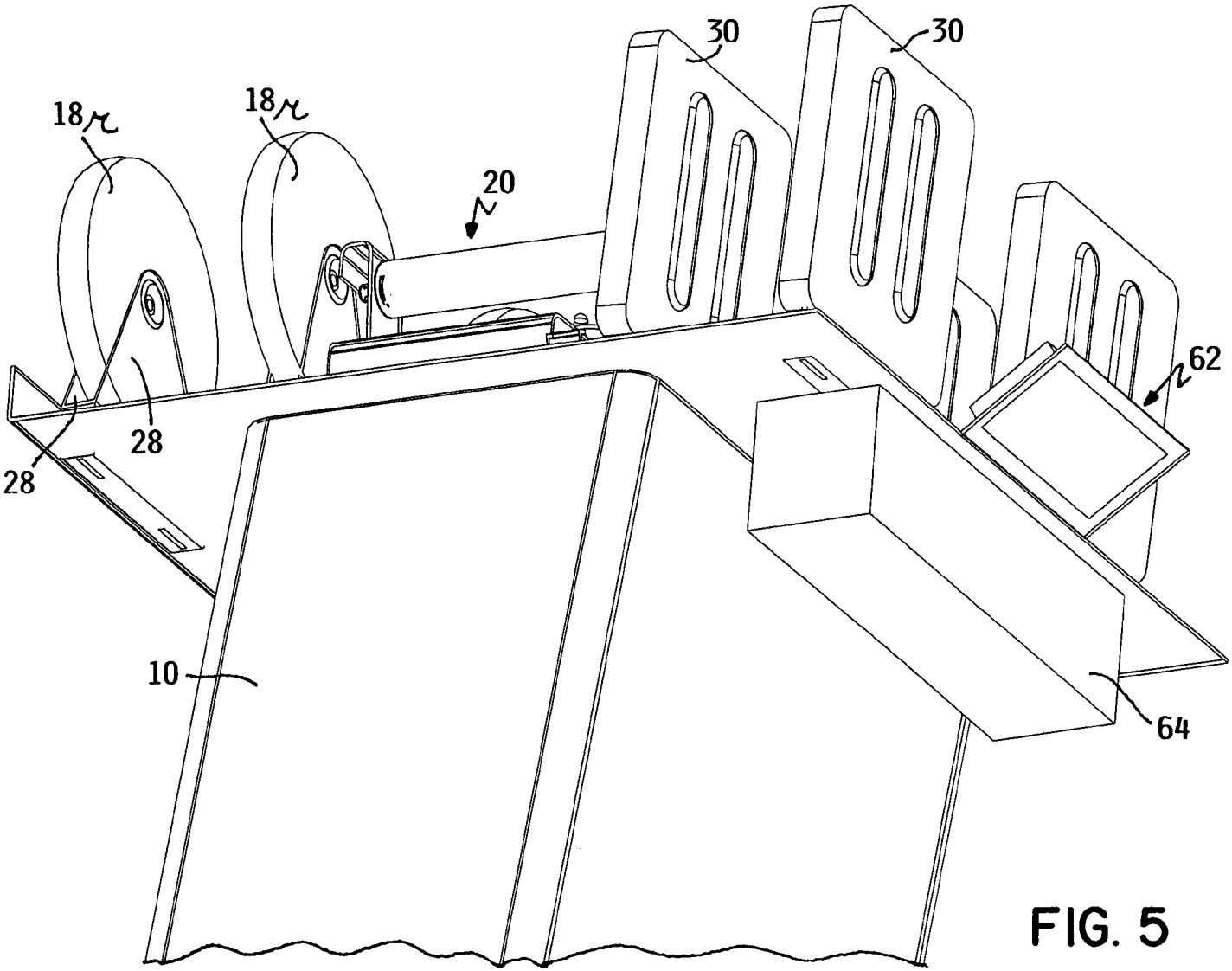
FIG. 5 is a perspective view from the back of the system of FIG. 1 and from below the support tray of the stand, particularly illustrating the pair of selectorized dumbbells atop the support tray of the stand.

In selectorized dumbbell 4 shown herein, each weight 16 comprises a left weight plate $\mathbf{18}_l$ and a right weight plate $\mathbf{18}_r$ joined together by a pair of front and back side rails $\mathbf{24}_f$ and $\mathbf{24}_b$. See FIG. 4. Each dumbbell can have any desired number of weights 16, but each dumbbell shown herein has a total of seven weights 16. Since each weight 16 includes one left weight plate $\mathbf{18}_l$ and one right weight plate $\mathbf{18}_r$, there will be a total of seven nested left weight plates $\mathbf{18}_l$ and seven nested right weight plates $\mathbf{18}_r$. For clarity, only two of the seven weights 16 are shown in the drawings, namely the first or innermost weight 16, i.e. the weight closest to handle 20, and the seventh or outermost weight 16, i.e. the weight furthest from handle 20. The other left and right weight plates $\mathbf{18}_l$ and $18_r$ of the other weights 16 will nest in between the illustrated left and right weight plates $18_l$ and $18_r$ of the first and seventh weights 16.

Weight plates 18 are attached to side rails 24 using carriers 26 that are bolted or screwed to inturned ends of side rails 24. The drawings illustrate two different carriers 26 on different ends of side rails 24 simply to illustrate different types of carriers that might be used. For example, one carrier 26 is fork-shaped having a pair of upwardly extending arms 28 that clamp weight plates 18 between them. The other carrier 26 is box-shaped with the weight plate being enclosed inside a surrounding box 30. As a practical matter, carriers 26 used on a particular dumbbell will typically be of the same type and not different types.

The use of carriers of some type to releasably attach weight plates is shown and described both in the assignee's published U.S. patent application 2004/0162198 as well as in the assignee's pending U.S. patent application Ser. No. 11/498,314 filed Aug. 2, 2006, both of which are hereby incorporated by reference. The latter pending patent application further shows and describes the fork-shaped carriers 26 with the upwardly extending arms 38.

Weights 16 of selectorized dumbbells 4 as shown herein can obviously be made in different ways. For example, carriers 26 could be deleted and weight plates 18 could be simply welded to side rails 24 or to other types of interconnecting members as shown in the 762 patent. Alternatively, weights 16 need not comprise a nested left weight plate $18_l$ and a nested right weight plate $18_r$ that are joined together. Instead, the nested left and right weight plates $18_l$ and $18_r$ could be separate from one another so that each weight 16 would then comprise merely a single weight plate $18_l$ or $18_r$. The use of separate weight plates 18 that are not joined together in pairs is well known in the selectorized dumbbell art.

Thus, the description of the structure of weights 16 provided herein is for illustrative purposes only. However, in a selectorized dumbbell, weights 16 will still be disposed in nested stacks of left and right weight plates $18_l$ and $18_r$, whether or not such weight plates are joined together in pairs.

With the types of weights 16 shown herein for selectorized dumbbell 4, front side rails $24_f$ overlie one another along a front side of dumbbell 4 and back side rails $24_b$ overlie one another along a back side of dumbbell 4. With this type of construction, it is well known in the selectorized dumbbell art, as shown in the 762 patent, to provide different configurations of holes and slots on the front and back side rails. For example, each side rail 24 could include a single connecting hole for receiving a connecting pin and various slots adjacent the hole. The position of the connecting hole is uniquely different for each side rail in the set of front side rails $24_f$ and in the set of back side rails $24_b$. This type of hole and slot configuration is shown in FIG. 22 of the 762 patent. This type of hole and slot configuration could be used in the front and back side rails $24_f$ and $24_b$, though other types of hole and slot configurations could also be devised.

Figure 8:
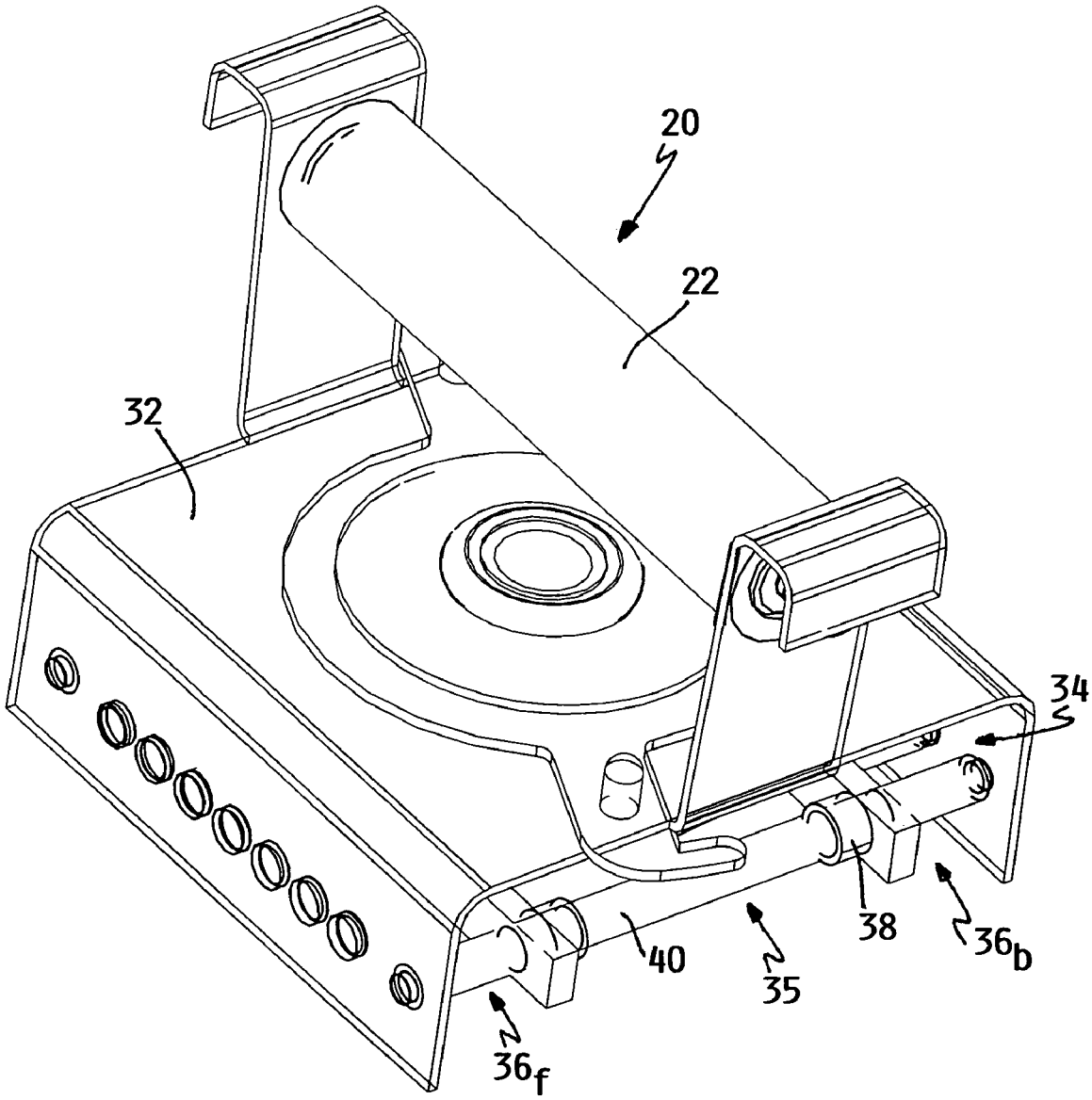
FIG. 8 is a perspective view of the handle of one of the selectorized dumbbells used in the system of FIG. 1.
Figure 9:
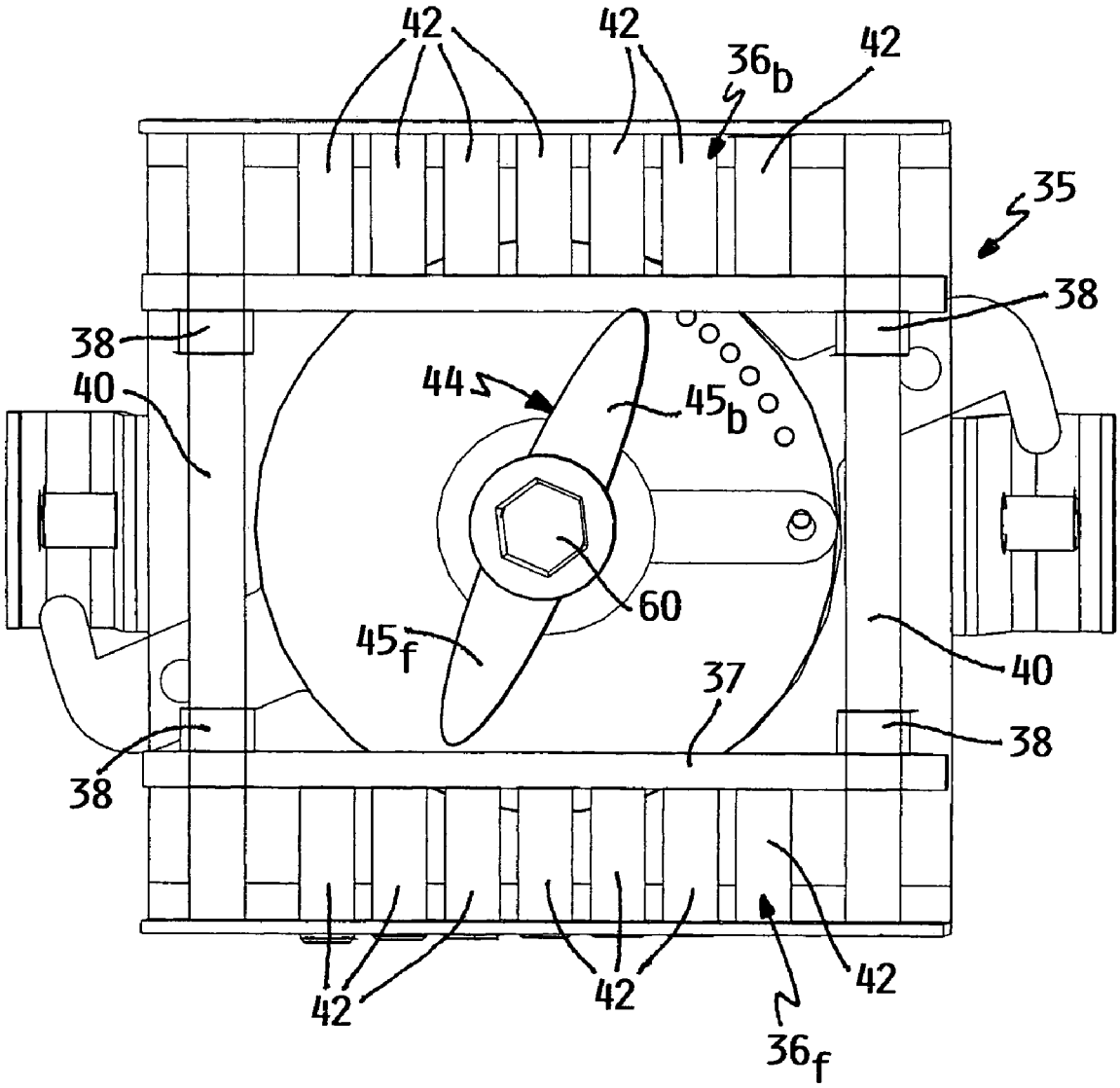
FIG. 9 is a bottom plan view of the handle of FIG. 8, particularly illustrating the front and back pin arrays used for coupling desired numbers of weights to the handle.
Figure 10:
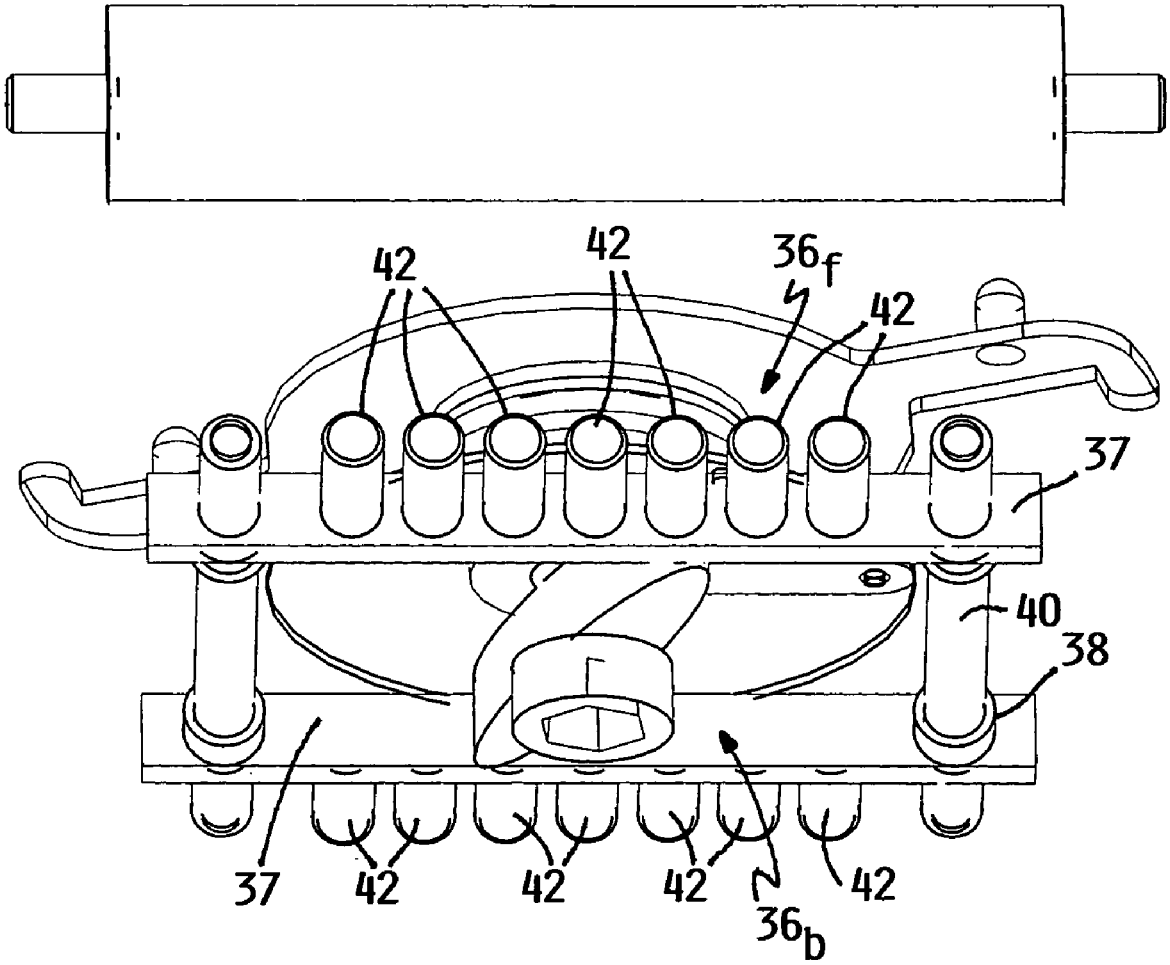
FIG. 10 is a perspective view of the bottom of the handle of FIG. 8, but with the U-shaped base of the handle having been removed to better illustrate the front and back pin arrays.

Referring now to FIGS. 8-10, handle 20 of dumbbell 4 includes a U-shaped base 32 defining an internal cavity 34. Cavity 34 houses a selector 35 having a pair of pin arrays 36. A front pin array $36_f$ points towards the front of handle 20 and towards front side rails $24_f$. Similarly, a back pin array $36_b$ points towards the back of handle 20 and back side rails $24_b$.

Each pin array 36 is slidably mounted by bushings 38 on a pair of guide rods 40 contained within cavity 34 of handle 20. Each pin array 36 includes a plurality of connecting pins 42 carried on a base 37. The number of connecting pins 42 is equal in number to the number of weights 16, i.e. seven connecting pins 42 for the seven different weights 16. Normally, when no weights are coupled to handle 20, each pin array 36 is retracted or slid inwardly on guide rods 40 relative to cavity 34 such that all connecting pins 42 are disposed inwardly of the adjacent set of side rails $24_f$ or $24_b$.

A double lobed rotatable cam 44 is contained in cavity 34 of handle 20 between front and back pin arrays $36_f$ and $36_b$. Return springs (not shown) can be installed on guide rods 40 urging pin arrays 36 inwardly into engagement with the lobes of cam 44. One lobe $45_f$ of cam 44 engages against front pin array $36_f$ and the other lobe $45_b$ of cam 44 engages against back pin array $36_b$. The exact lateral positioning of each pin array 36 within cavity 34 of handle 20 will be determined by the rotary position of cam 44.

If cam 44 is incrementally rotated, the front and back pin arrays $36_f$ and $36_b$ can be incrementally moved out relative to handle 20 in a step-by-step, progressive fashion. This can be done in seven steps corresponding to the seven weights 16. In each increment of movement of pin arrays 36, one connecting pin 42 on each pin array 36 will enter a different one of the holes on side rails $24_f$ and $24_b$ to pick up another weight 16 to attach weight 16 to handle 20. Preferably, this will be done beginning with the first or innermost weight 16, then with the second weight 16, the third weight 16, and so on, until ending with the seventh or outermost weight 15. Thus, the weight of selectorized dumbbell 4 is adjusted by progressively sliding the front and back pin arrays 36 apart to pick up each of the seven weights 16 in turn. Cam 44 could be locked in any of its incrementally advanced positions by a suitable detent system operable between cam 44 and an adjacent fixed portion of handle 20.

Figure 7:
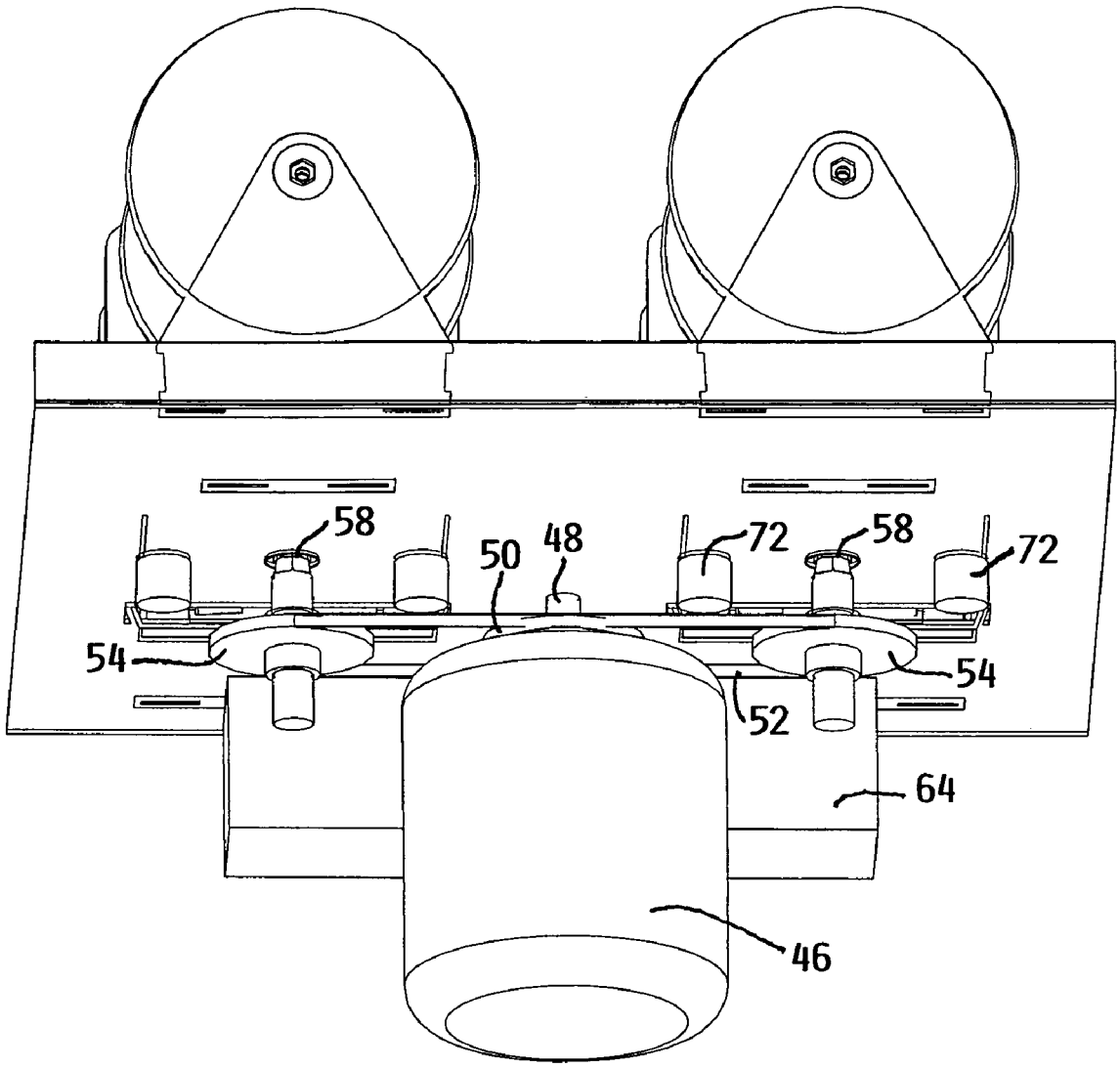
FIG. 7 is a perspective view similar to FIG. 6, but looking at the underside of the support tray from the front to again illustrate the motor drive to the pair of selectorized dumbbells along with the mechanical interlock fingers and electrical interlock sensors.

In system 2 of this invention, the actuation or operation of selector 35, namely the movement of the front and back pin arrays $36_f$ and $36_b$, is accomplished using a motor 46. See FIGS. 7 and 8. In particular, an electric motor 46 which converts electric energy into the rotation of a motor drive shaft 48 is carried within column or post 10 of stand 4. Motor drive shaft 48 mounts a drive pulley 50 which is coupled by a belt 52 to a pair of driven pulleys 54 mounted on a pair of driven shafts 56. Driven shafts 56 are also contained within column or post 10 of stand 4. Thus, motor 46, pulleys 50 and 54, belt 52, and driven shafts 56 are normally enclosed within stand 4 beneath support tray 12.

Each driven shaft 56 has an upper end that forms a rotatable driver 58 that sticks through an opening in support tray 12. When selectorized dumbbells 4 are laid onto support tray 12 in their designated spots with one lateral side of each dumbbell 4 engaging against front lip of 14 support tray 12, each rotatable driver 48 will be aligned with and will enter into a socket 60 formed on the bottom of cam 44 on one dumbbell 4. Socket 60 is shown in FIG. 9. This is how rotation of motor 46 is simultaneously transmitted through the belt and pulley drive to both cams 44 of both dumbbells 4, namely through the pair of rotatable drivers 58. One driver 58 will rotate cam 44 on the first dumbbell while the other driver 58 will simultaneously and identically rotate cam 44 on the other dumbbell.

A data entry device 62 is provided on stand 4 to allow a user to input a weight selection decision into an electrical or electronic controller 64 that interfaces between data entry device 62 and motor 46. Controller 64 could be a part of data entry device 62 or a part of motor 46. Various types of data entry devices 62 could be used, but a device similar to a PDA or cell phone is preferred, namely a device 62 having a visual display 66 and a plurality of data entry keys or buttons 68. Data entry keys or buttons 68 could be virtual keys or buttons that are electronically shown on display 66 in the manner of a touch screen.

The user can use data entry device 62 to input a desired weight selection for dumbbells 4. For example, if the user wishes that dumbbells 4 be adjusted to twenty pounds (corresponding to the coupling of the first two weights 16 to handle 20), then the user can use keys or buttons 68 of data entry device 62 to input a twenty pound weight selection decision. Display 66 will show the amount of weight the user has selected and can then, if desired, ask the user to confirm the weight selection decision. Again, the type of data entry device 62, the kinds of steps the user might have to take to input the weight selection decision he or she has made, the types of displays 66 or menus that might be used on such displays, can obviously vary.

Figure 6:
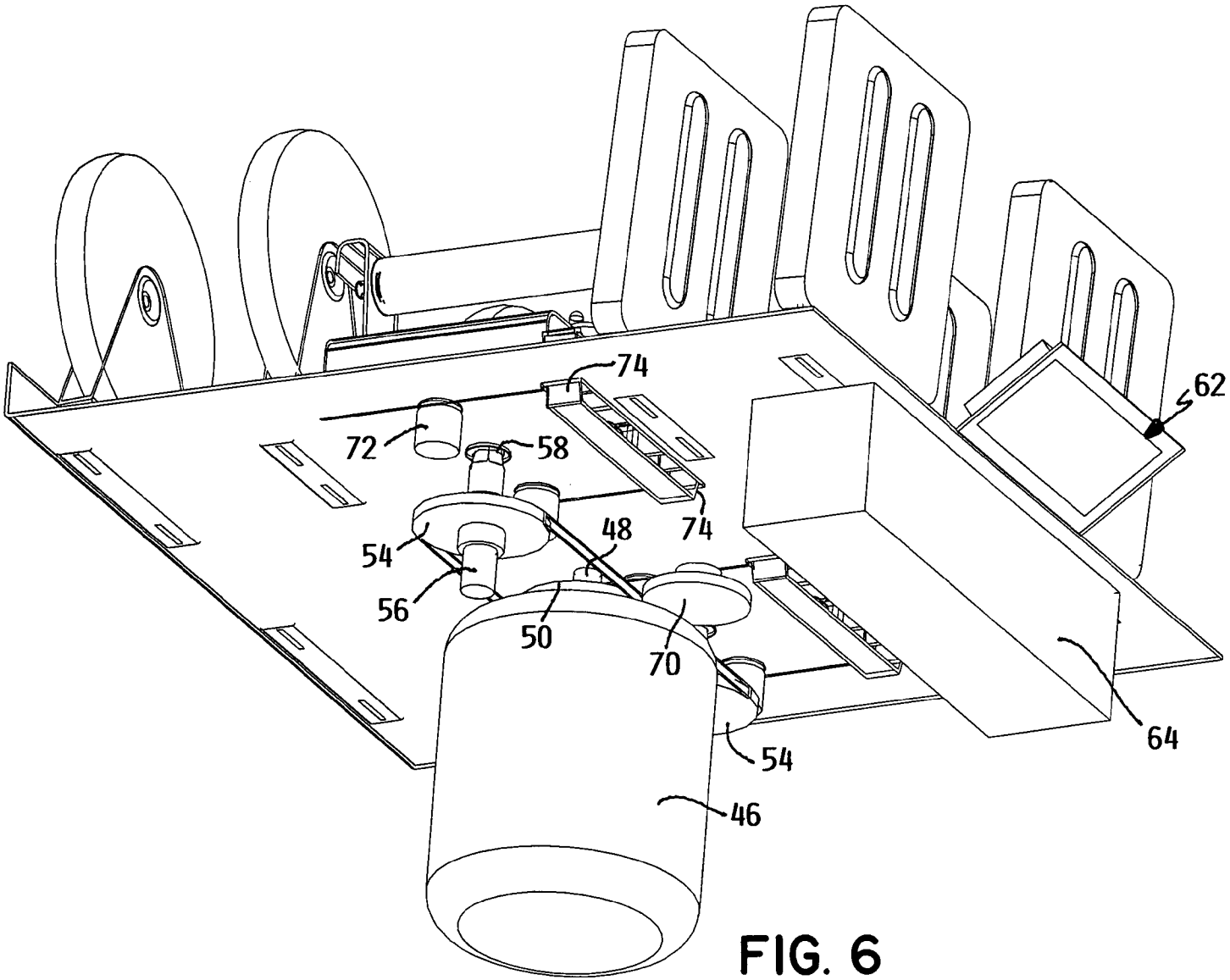
FIG. 6 is a perspective view similar to FIG. 5, but with the vertical column or post of the stand having been removed to better illustrate the motor used to rotate the pair of rotatable drivers that simultaneously adjust the weight of both selectorized dumbbells.

Once the user has made a weight selection decision, input that decision into data entry device 62, and then confirmed that decision if confirmation is required by data entry device 62, then controller 64 can selectively apply electrical power to motor 46. The amount and/or duration of such power is controlled to incrementally advance motor 46, and thus the two rotatable drivers 58, far enough to pick up the desired number of weights 16. Precise control of the rotation of motor 46 can be achieved using a stepper motor or a shaft encoder 70 (shown in FIG. 6) to precisely measure and determine the amount of rotation of motor drive shaft 48.

In the example above of a twenty pound weight selection, motor 46 and drivers 58 are rotated just far enough that the front and back pin arrays $\mathbf{36}_f$ and $\mathbf{36}_b$ have advanced two steps to insert connecting pins 42 through the holes of side rails $\mathbf{24}_f$ and $\mathbf{24}_b$ for the first two weights 16. Once the weight adjustment has been accomplished by system 2, the user can then lift dumbbells 4 off support tray 12 of stand 4 and begin to exercise with them. Each dumbbell will carry twenty pounds, namely the first two weights 16 will have been coupled to handle 20 of each dumbbell, just as the user requested when he or she input the weight selection decision into data entry device 62. However, the actual adjustment will have been made using a motor 46 to actuate selectors 35 of dumbbell 4 without needing further intervention by the user, i.e. without the user having to physically or directly position or manipulate selector 35. The other unused weights 16 will remain atop stand 4.

One or more electronic sensors 72 are positioned on support tray 12 to detect the presence of each selectorized dumbbell in the proper weight adjusting position on support tray 12. For example, two such sensors 72 are shown for each dumbbell, one sensor 72 underlying each of the front and back sides of dumbbell 4 when dumbbell 4 is properly laid down on support tray 12. Unless sensors 72 determine that selectorized dumbbells 4 are in place, no weight adjustment operation can take place. In other words, even if the user inputs a weight selection decision into data entry device 62, controller 64 will not activate motor 46 to implement that decision unless sensors 72 have reported to controller 64 that both dumbbells are on stand 4 and are in their proper position. Support tray 12 of stand 4 may have various dumbbell aligning grooves, recesses or detents (not shown) to help the user position each dumbbell 4 in its proper weight adjusting position.

In addition, a pair of mechanical interlock fingers 74 are provided on support tray 12 for each dumbbell to help hold dumbbell 4 securely in place during a weight adjustment operation. Interlock fingers 74 project through slots 76 in support tray 12 from below support tray 12. Normally, interlock fingers 74 are pivoted outwardly away from one another so that there is sufficient room to place one dumbbell 4 between them. However, once a weight adjustment operation begins, interlock fingers 74 are pivoted or moved by controller 64 towards one another until lips or tabs 78 formed at the top of interlock fingers 74 protrude over or clamp on top of side rails 24 of dumbbells 4. Interlock fingers 74 physically hold dumbbells 4 on support tray 12 and prevent them from being removed until interlock fingers 74 are pivoted back to their outwardly canted, disengaged position.

Interlock fingers 74 prevent the rotation of driver 58 from simply twisting or rotating dumbbell 4 on stand 4. Instead, interlock fingers 74 keep dumbbell 4 in place on stand 4 and prevent the torque of driver 58 from twisting or rotating dumbbell 4 around. Instead, the torque of driver 58 is effective to rotate cam 44 to slide pin arrays 36 out a desired amount.

Interlock fingers 74 also comprise a safety feature. Interlock fingers 74 prevent the user from picking up and using dumbbells 4 until the weight adjustment operation is fully and correctly completed. Controller 64 can be programmed to require that a signal be delivered to it in some fashion indicating that each pin array 36 has properly engaged the desired number of weights 16 to handle 20. If this signal is not received, or if an error signal is received due to overheating or jamming of motor 46 or of drivers 58, controller 64 will simply leave interlock fingers 74 in their engaged positions to keep dumbbells 4 locked to support tray 12. This prevents the user from picking up and using a dumbbell 4 in which connecting pins 42 may not have been correctly inserted, thus enhancing safety in the use of dumbbells 4.

How interlock fingers 74 pivot can be accomplished in various ways. Each interlock finger 74 could be L-shaped and mounted on its own separate pivot beneath support tray 12 to swing lips or tabs 78 on fingers 74 inwardly and outwardly relative to selectorized dumbbells 4. Or, the vertical portions of fingers 74 that carry lips or tabs 78 could be flexibly or pivotably mounted to a common, vertically movable base with the vertical portions of the fingers simply flexing or pivoting inwardly and outwardly as the base is raised or lowered. Thus, the structure and exact method of operation of interlock fingers 74 can obviously be varied.

A clutch (not shown) could be used somewhere in the drive train between motor 46 and selector 35 of selectorized dumbbell 4. For example, a clutch could be used between drive shaft 48 of motor 46 and the shaft of drive pulley 50. Thus, if there was any problem in moving the front and back pin arrays $\mathbf{36}_f$ and $\mathbf{36}_b$ into a selected weight engaging position, due to a malfunction in any of the components of the drive train or to misalignment in any of the components of selector 35, then the clutch would at some point release or unclutch to prevent damage. Thus, the clutch serves as a safety device and prevents an overload of motor 46 or jamming of selector 35.

Figure 11:
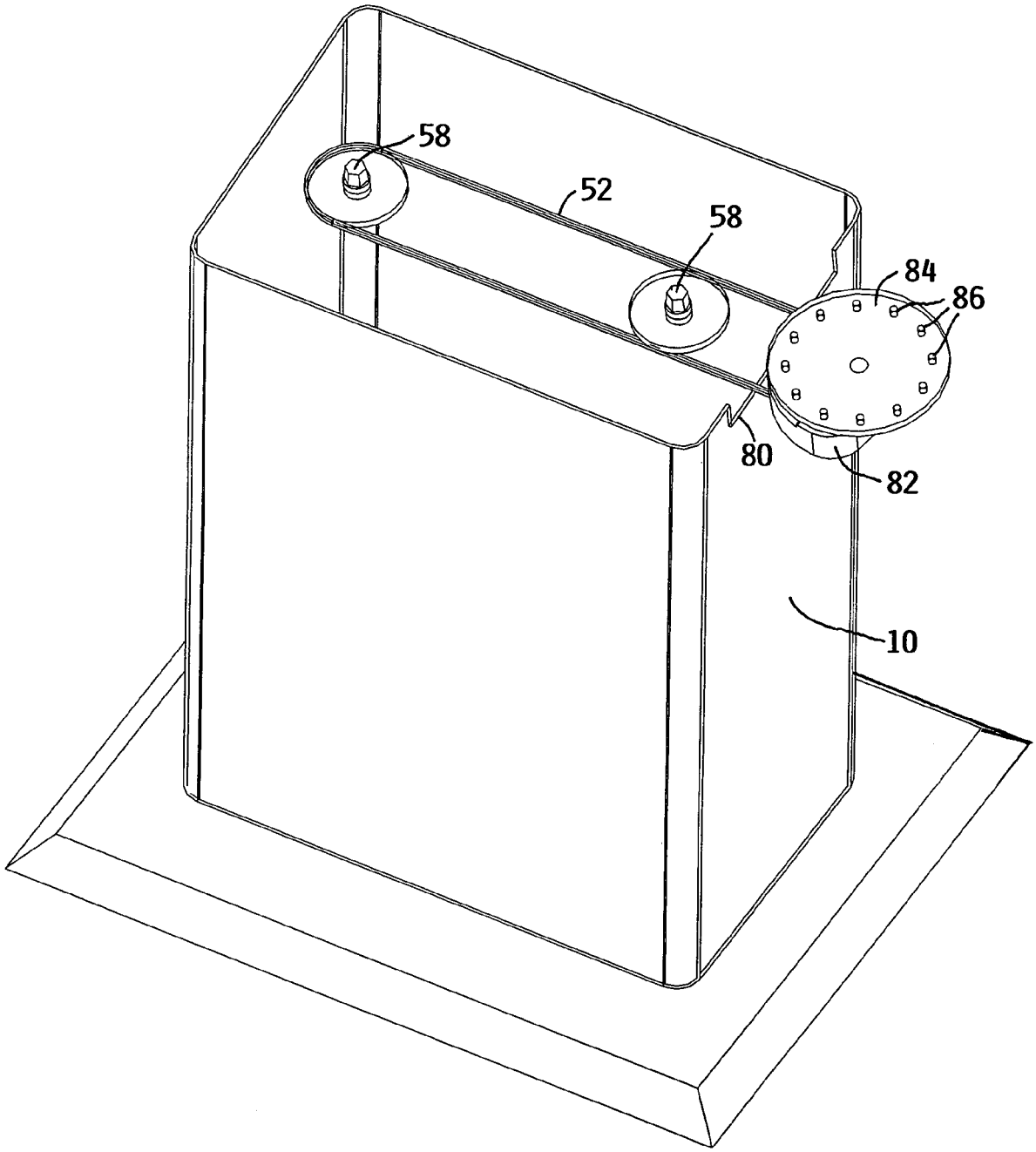
FIG. 11 is a perspective view of a portion of a second embodiment of a weight selection and adjustment system for selectorized dumbbells according to this invention, particularly illustrating only a portion of the support stand to thereby depict a system for manually but remotely and simultaneously adjusting the weight of a pair of selectorized dumbbells.

Referring now to FIG. 11, the motorized system 2 of FIGS. 1-10 could be replaced with a manual system. In the manual system, motor 46 is deleted. The belt drive 52 to the two rotatable drivers 58 is extended out through a slot 80 in column or post 10 of stand 4 into a pulley housing 82 secured on one side of column or post 10. This pulley housing encloses the drive pulley (not shown) on which belt 52 is entrained. The drive pulley is rotatably coupled to a shaft (not shown) that carries a rotatable thumb or hand wheel 84. Hand wheel 84 is carried outside of and atop pulley housing 82 to be accessible to the user.

In order to remotely but simultaneously adjust weights 16 of a pair of selectorized dumbbells (not shown in FIG. 11 but like that of FIG. 1) carried atop support tray 12 (not shown in FIG. 11 but like that of FIG. 1), the user need only grab and rotate hand wheel 84 to incrementally rotate hand wheel 84. Hand wheel 84 is preferably provided with a plurality of holes or openings 86 that cooperate with a detent (not shown) on the top of pulley housing 82 for allowing the user to know how far to incrementally advance hand wheel 84. In any event, incremental rotation of hand wheel 84 will incrementally advance belt 62 and thus rotate drivers 58 to adjust the weight of selectorized dumbbells 4 as in the embodiment of FIGS. 1-10, except that the incremental rotation is now being done by a manually operated hand wheel 86 rather than by an electrically powered motor 46.

In the manual system of FIG. 11, data entry device 62, controller 64, motor 46, and interlock sensors 72 would all be deleted when the manual system is used as a replacement for the motorized system 2 of FIGS. 1-10. However, these components could all be kept if the manual system of FIG. 11 is used as a backup for the motorized system 2 of FIGS. 1-10. In this latter case, the belt drive from motor 46 is simply extended out through the side of column or post 10 of stand 4 and pulley housing 82 and manual hand wheel 84 would be additionally added to stand 4. Hand wheel 84 would be used in the event of a power failure or the like in order to manually adjust the weight of dumbbells 4.

Figure 12:
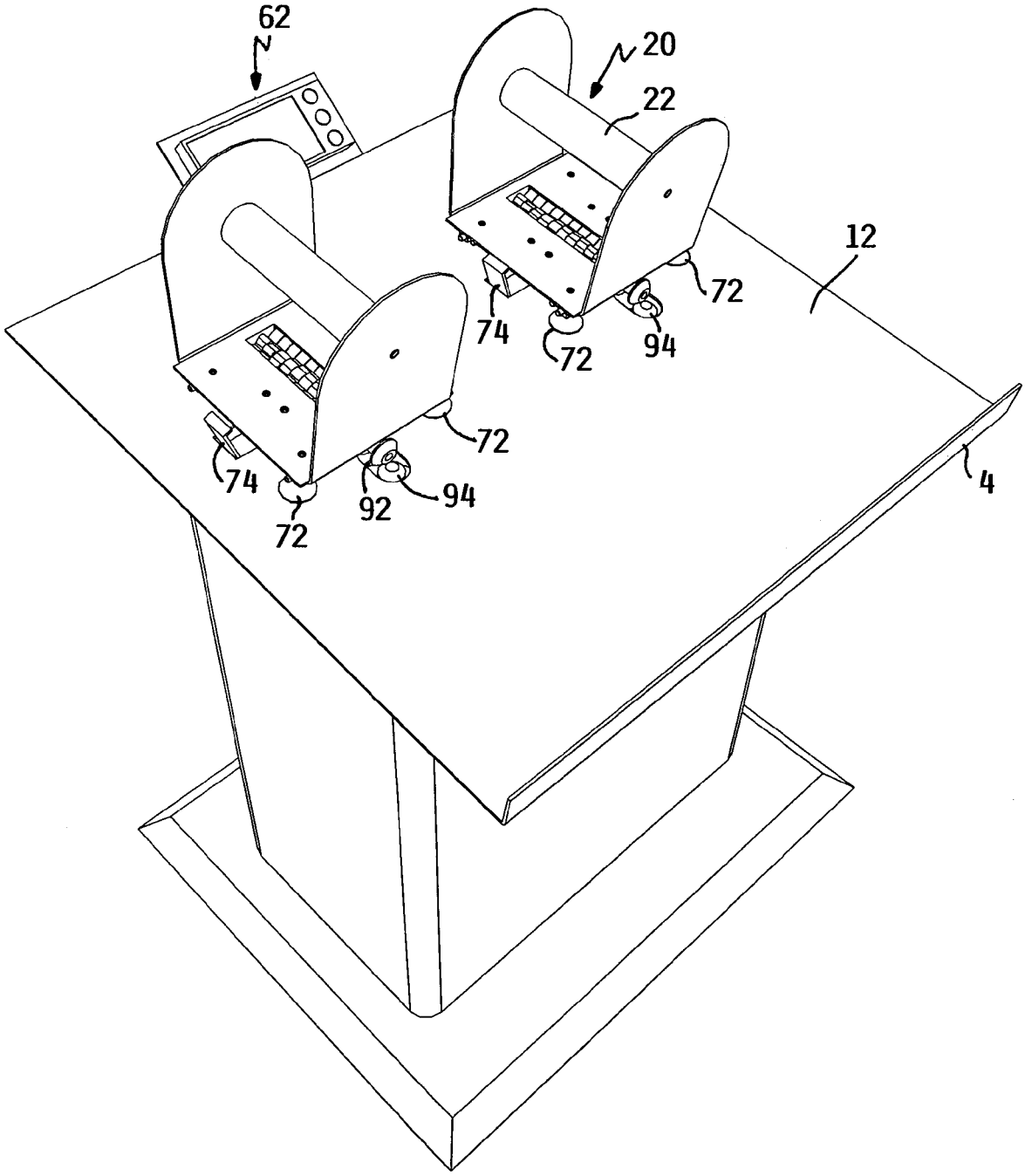
FIG. 12 is a perspective view of a third embodiment of a weight selection and adjustment system for selectorized dumbbells according to this invention, particularly illustrating a system used to adjust the weight of a pair of selectorized dumbbells placed atop a support stand.
Figure 13:
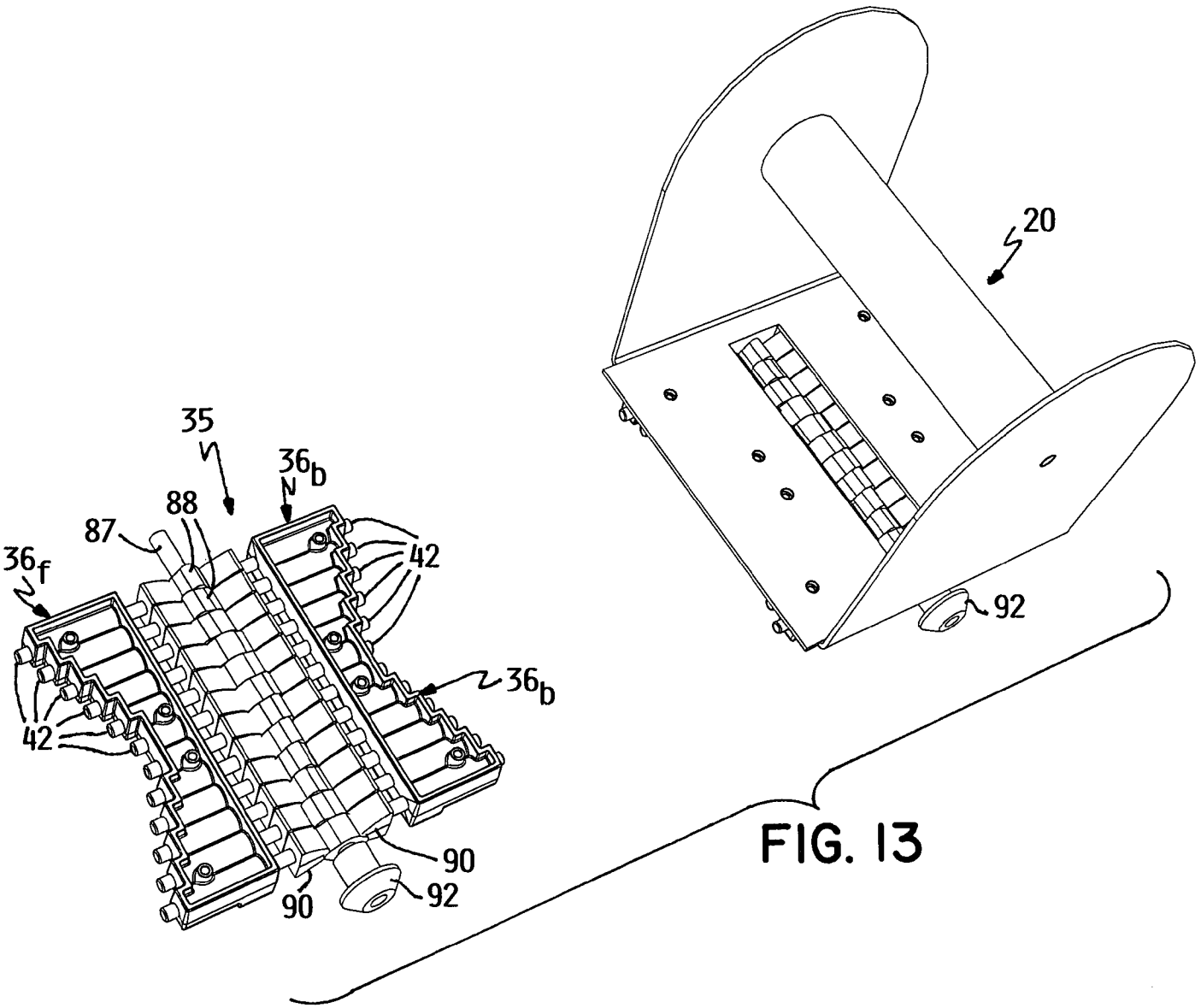
FIG. 13 is a partial perspective view of a portion of the third embodiment of FIG. 12, particularly illustrating the handles for the selectorized dumbbells with a portion of one of the handles having been omitted to better illustrate the selector used on each handle.

Referring now to FIGS. 12 and 13, it is obvious that selectors 35 of selectorized dumbbells 4 can have many forms that will dictate various different connections to the rotatable drivers 58. In FIG. 12, handles 20 for two selectorized dumbbells are shown with weights 16 of dumbbells 4 having been deleted for the purpose of clarity. Handles 20 of dumbbells 4 will be positioned atop support tray 12 of stand 4 similarly to that shown in FIGS. 1-10, namely overlying interlock sensors 72 and in position to be grabbed or gripped by interlock fingers 74. The primary difference between this embodiment and what is shown in FIGS. 1-10 is the nature of selector 35 used on each selectorized dumbbell 4.

As shown in FIG. 13, each selector 35 comprises a front pin array $\mathbf{36}_f$ and a back pin array $\mathbf{36}_b$ with a plurality of connecting pins 42 contained in a chevron shape and arranged in duplicate left and right sets. This type of selector is shown and described more completely in the assignee's pending patent application Ser. No. 11/498,335 filed Aug. 2, 2006, which application is hereby incorporated by reference.

Each weight 16 will be coupled to handle 20 by a pair of connecting pins 42, one from the left set and a corresponding one from the right set, that will be thrown or moved outwardly to enter into holes in side rails $\mathbf{24}_f$ and $\mathbf{24}_b$ of each weight 16. The pairs of connecting pins 42 are thrown beginning with the innermost pair of pins and then progressively moving outwardly through the other pairs of pins. Selector 35 shown in FIG. 13 is designed to pick up six different weights, i.e. there are a total of twelve pins 42 in each pin array $\mathbf{36}_f$ and $\mathbf{36}_b$ with six pins 42 in the left set and six pins 42 in the duplicate right set.

Pins 42 in the front and back pin arrays $\mathbf{36}_f$ and $\mathbf{36}_b$ are thrown outwardly by a rotatable camshaft 87 arranged between the two pin arrays. Camshaft 87 has a plurality of lobes 88 that bear against arrow-shaped heads 90 of the various connecting pins 42. Heads 90 are spring biased inwardly to abut against the lobes 88 of camshaft 87. One end of camshaft 87 carries a bevel gear 92. The end of driver 58 that protrudes through support tray 12 of stand 4 also carries a bevel gear 94. The two bevel gears 92 and 94 interengage.

When the user inputs a weight selection decision into data entry device 62, controller 64 effects rotation of motor 46 to incrementally rotate the two drivers 58 for the pair of selectorized dumbbells 4. This rotates each camshaft 87 identically about the axis of each camshaft 87. The incremental rotation of camshafts 87 will cause the lobes 88 thereon to incrementally throw connecting pins 42 outwardly in the various pairs thereof beginning with the innermost pair and working outwardly to the outermost pair.

Figure 14:
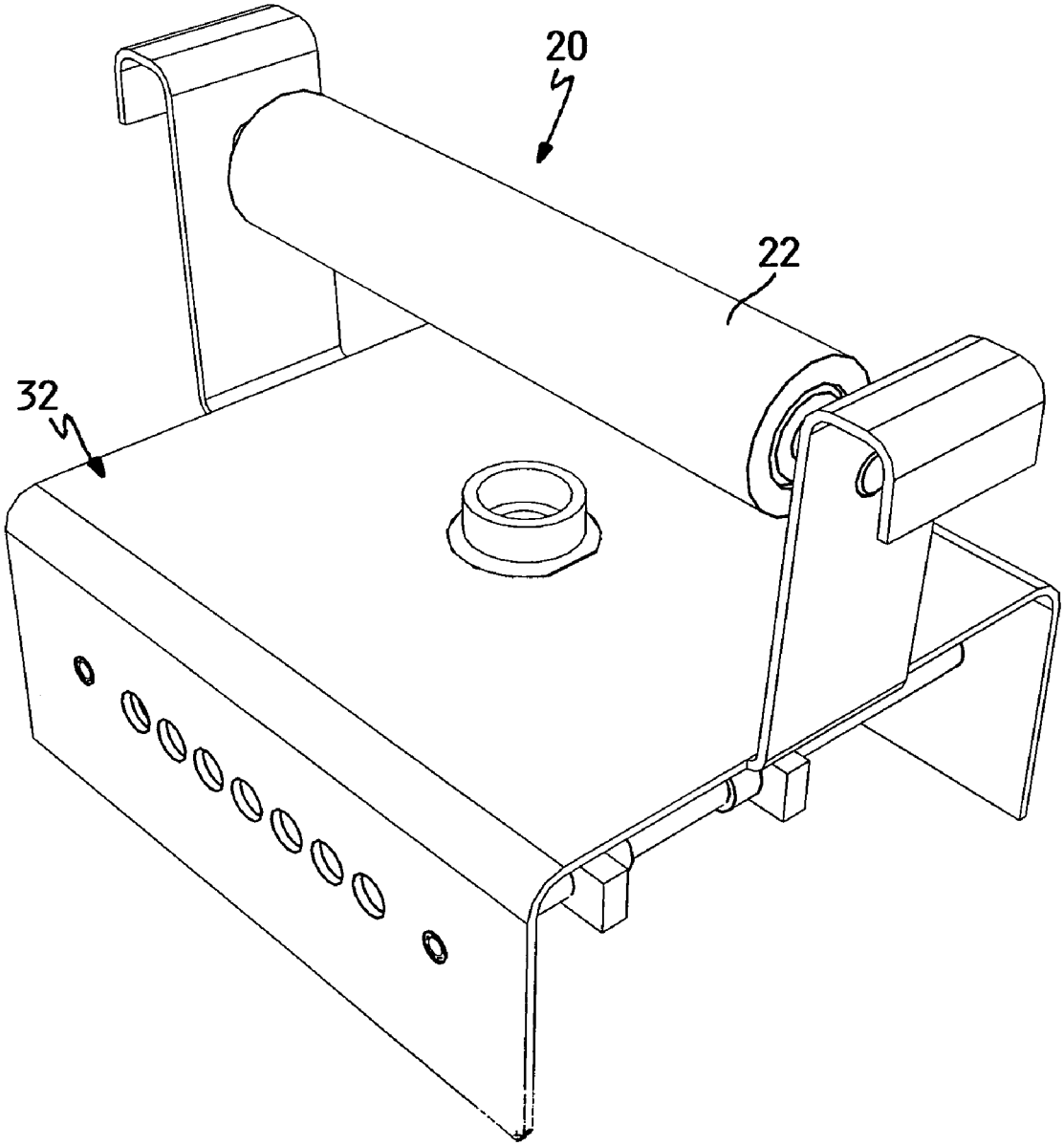
FIG. 14 is a perspective view of a handle of a selectorized dumbbell that is used as part of a fourth embodiment of a weight selection and adjustment system for selectorized dumbbells according to this invention.
Figure 15:
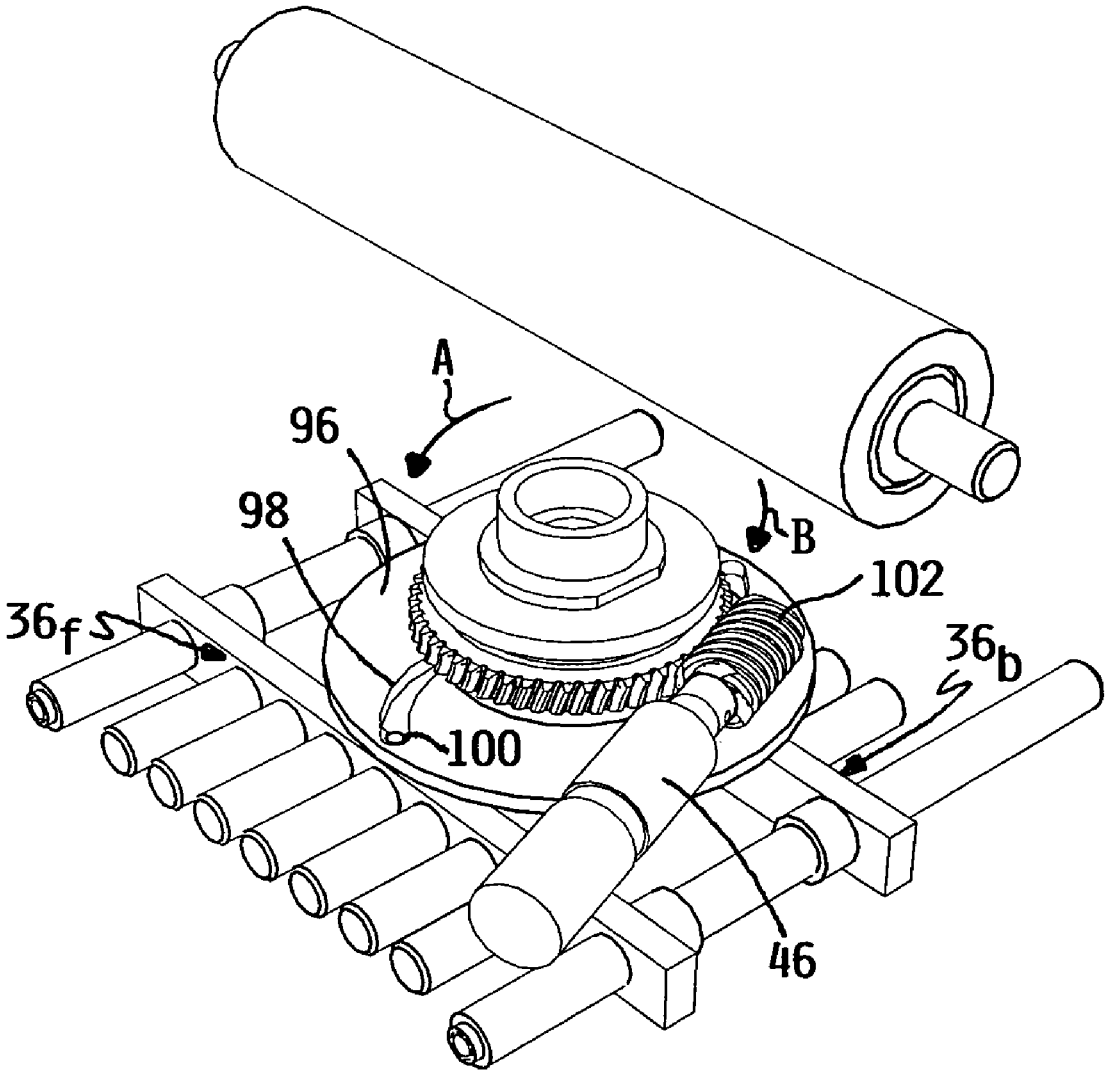
FIG. 15 is a perspective view similar to FIG. 14, but particularly illustrating the handle with the U-shaped base of the handle removed to illustrate a handle carried motor for operating the selector.

Referring now to FIGS. 14 and 15, a handle 20 generally similar to that shown in FIGS. 1-10 is illustrated. Handle 20 differs, however, in how front and back pin arrays $\mathbf{36}_f$ and $\mathbf{36}_b$ are slid laterally inwardly and outwardly. Instead of relying upon a double lobed rotatable cam 44 as shown in FIGS. 1-10, handle 20 has a rotatable drive gear 96. Drive gear 96 includes a spiral cam slot 98 on each side thereof with only one such cam slot 98 being shown in FIG. 15. A pin 100 on the adjacent pin array is continuously received in such cam slot 98. Again, FIG. 15 shows only one such pin 100 with the pin 100 and cam slot 98 on the other side of drive gear 96 being hidden in FIG. 15.

Rotation of drive gear 96 in opposite directions in FIG. 15 will move pin arrays $\mathbf{36}_f$ and $\mathbf{36}_b$ inwardly and outwardly through the cooperation of pins 100 and cam slots 98. When drive gear 96 rotates in the direction of the arrow A in FIG. 15, cam slots 98 acting on pins 100 will retract or slide pin arrays 36 inwardly. Conversely, rotation of drive gear 96 in the opposite direction B in FIG. 15 will cause cam slots 98 to push outwardly on pins 100 to extend or slide pin arrays 36 outwardly. No spring biasing is necessary in this arrangement since cam slots 98 continuously engage pins 100 and push on pins 100 in the appropriate direction regardless of the direction of rotation of drive gear 96.

Another difference in the embodiment of FIGS. 14 and 15 is that motor 46 used for driving or incrementally rotating drive gear 96 is contained or carried on handle 20 in cavity 34 thereof. Preferably, motor 46 is a stepper motor. Drive shaft 48 of motor 46 carries a worm gear 102. Worm gear 102 mates with the gear teeth on the outer diameter of drive gear 96. Motor 46 will be powered in any suitable manner, either by an internally contained battery (not shown) or by a power connection that is made when each selectorized dumbbell 4 is placed on top of support tray 12 in position for a weight adjustment operation.

In using handle 20 of FIGS. 14 and 15, handle 20 will be placed as in the embodiment of FIGS. 1 and 10 between the nested left and right stacks of weight plates $\mathbf{18}_l$ and $\mathbf{18}_r$ that are disposed atop stand 4. The user can use data entry device 62 as before to input a weight selection decision. Interlock fingers 74 and interlock sensors 72 will function as before. Controller 64 will then send a signal to the handle carried motors 46, either by a hardwired connection established when dumbbells 4 are placed on support tray 12 or by a wireless signal, to energize motors 46 to select a desired amount of weight.

Use of a geared electric drive as just described provides additional safety in the use of dumbbells 4. There are no external tether cords or the like which can catch on obstacles and cause a manually positioned selector pin to dislodge as is the case with prior art selectorized dumbbells. Instead, the stepper motor 46 and its geared connection to selector 35 as in FIGS. 14 and 15 effectively holds or locks selector 35 in place. There are no external parts of selector 35 that can be bumped or hit to cause the selector 35 to dislodge.

Figure 16:
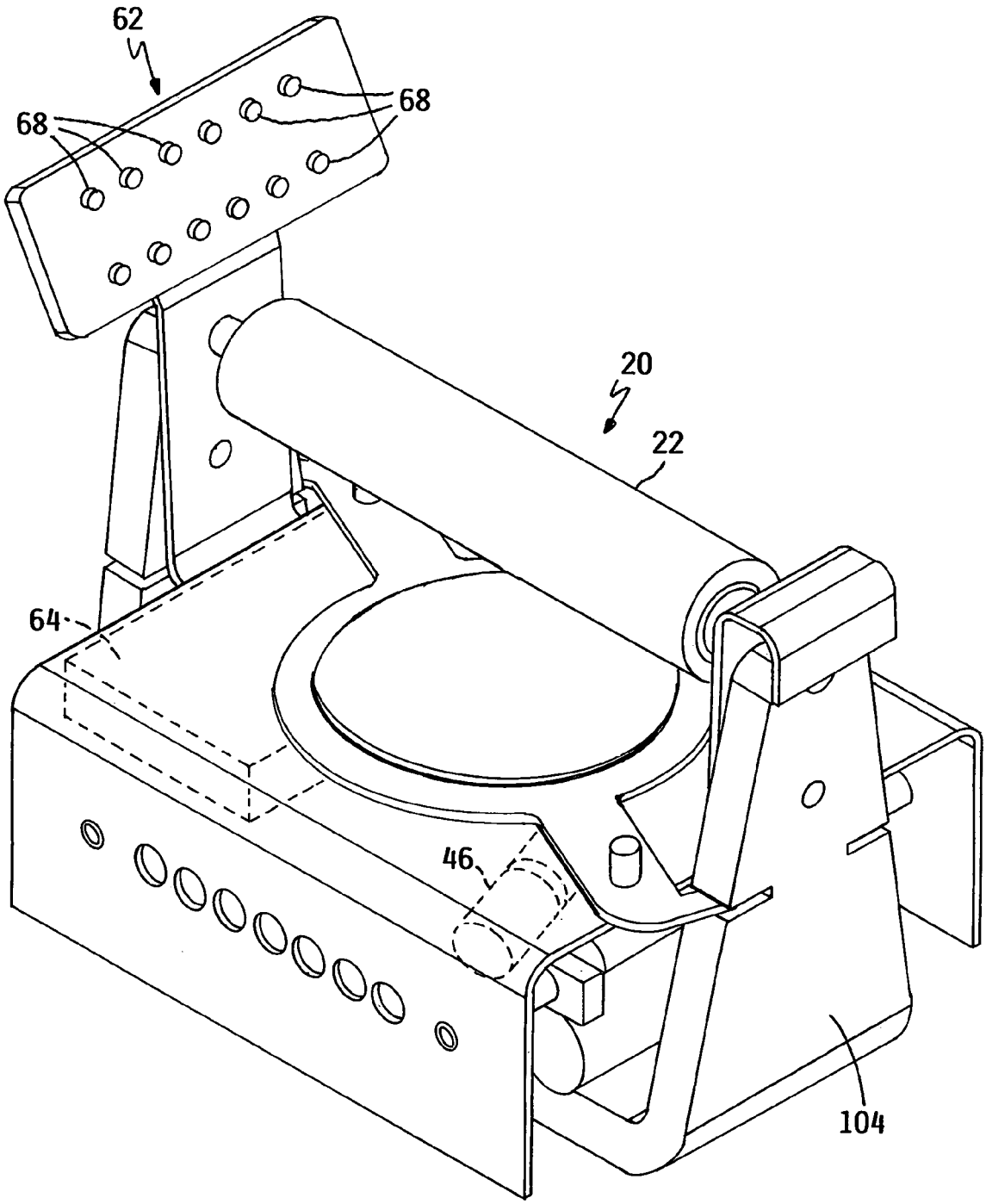
FIG. 16 is a perspective view of a handle of a selectorized dumbbell that is used as part of a fifth embodiment of a weight selection and adjustment system for selectorized dumbbells according to this invention, particularly illustrating a handle in which both the motor, data entry device and controller are carried on the handle.

FIG. 16 shows a further variation of the embodiment of FIGS. 14 and 15. In this embodiment, data entry device 62 is also located or carried on handle 20 as is controller 64. Controller 64 is carried in cavity 34 of handle 20 and is simply wired to motor 46. Electrical power will be supplied by a battery that is carried somewhere on handle 20. Handle 20 can itself include a U-shaped auxiliary weight 104 if so desired.

In the FIG. 16 embodiment, the weight on each selectorized dumbbell is set separately and not simultaneously. Each dumbbell 4 carries its own entire weight selection and adjustment system comprising a data entry device 62, a controller 64, a motor 46, and a battery (not shown) for powering the same. Dumbbells 4 can be adjusted when sitting on a stand 4 like that shown in FIGS. 1-10 or when sitting elsewhere. However, the ability to adjust controller 64 using an electronic data entry device 62 and an electrically operated motor 46 is the same. The user is no longer required to manually reposition or move selector 35 by grabbing selector 35 and applying physical force to the same. Alternatively, a single data entry device 62, mounted on only one dumbbell 4 or even separately from either dumbbell 4, could be used to set the weight selection decision for both dumbbells with the weight adjustment then being done either separately or simultaneously using the motor 46 that is part of each dumbbell.

The various embodiments of the invention disclosed herein all have various advantages. The motorized systems shown herein that are operated through an electronic data entry device 62 are all easy and simple to operate. It allows the user to make and input a weight selection decision using a data entry device 62 of the type with which the user is already familiar from many other fields. Both dumbbells 4 can be remotely adjusted since the user need only touch and manipulate data entry device 62 and not dumbbells 4 themselves. This can be done from the side of stand 4 or even further away if data entry device 62 wirelessly communications with controller 64 or motor 46. Moreover, both dumbbells 4 are simultaneously adjusted. This saves time and is extremely convenient for the user.

In addition, the systems of this invention has various safety features. Interlock sensors 72 prevent a weight adjustment operation from taking place unless dumbbells 4 are properly oriented on support tray 12 of stand 4. Interlock fingers 74 will grip dumbbells 4 and secure them to stand 4 during a weight adjustment operation. Interlock fingers 74 will not release dumbbells 4 for use unless the weight adjustment operation has been properly performed by system 2. Accordingly, it minimizes the chance for operator error in adjusting weights 16 and ensures that selector 35 is properly engaged before the user can grip and lift dumbbells 4 off stand 4.

While the manual system disclosed herein does not incorporate motor activation or an electronic data input entry device, it still features remote and simultaneous actuation of a pair of dumbbells using a single operator, i.e. hand wheel 84.

Various modifications of this invention will be apparent to those skilled in the art. For example, the term "motor" or "motorized" is not to be limited to the specific type of motor 46 shown herein having a rotatable drive shaft 48, but is meant to apply to any powered device that converts electrical energy into physical motion, e.g. a solenoid, a magnet, etc. In addition, as shown in FIG. 16, data entry device 62 could lack a visual display 66 and have only keys or buttons 68. Thus, this invention is not limited to the specific details of the embodiments disclosed herein.

We claim:

1. A weight selection and adjustment system for a selectorized dumbbell, which comprises:

(a) a selectorized dumbbell, which comprises:

(i) a stack of nested left weight plates and a stack of nested right weight plates;

(ii) a handle having a left end and a right end; and (iii) a movable selector having a plurality of different adjustment positions in which the selector may be disposed, wherein the selector is configured to couple selected numbers of left weight plates to the left end of the handle and selected numbers of right weight plates to the right end of the handle with the selected numbers of coupled weight plates differing depending upon the adjustment position in which the selector is disposed, thereby allowing a user to select for use a desired exercise weight to be provided by the selectorized dumbbell; and (b) an electric motor that is operatively connected to the selector at least whenever a weight adjustment operation takes place, wherein the electric motor when energized from a source of electric power physically moves the selector into the adjustment position corresponding to the desired exercise weight that was selected for use by the user.

2. The system of claim 1, further comprising:

(a) an electrically operated data entry device to allow the user to input the desired exercise weight; and (b) a controller operatively communicating with the data entry device and the electric motor for energizing the electric motor from the electric power source to cause the electric motor to move the selector to the adjustment position thereof that corresponds to the desired exercise weight input by the operator into the data entry device.

3. The system of claim 1, wherein the data entry device includes data entry keys or buttons that may be manipulated by the user for allowing the user to input the desired exercise weight into the data entry device.

4. The system of claim 3, wherein the data entry device further includes a visual display for displaying back to the user the desired exercise weight that has been input into the data entry device by the user by manipulation of the keys or buttons.

5. The system of claim 2, further comprising:

(a) a stand on which the selectorized dumbbell is supported during a weight adjustment operation;

(b) wherein the motor is mounted on the stand; and (c) a driver releasably connected to the selector of the dumbbell when the dumbbell is on the stand with the driver being driven by the motor when the motor is energized.

6. The system of claim 5, wherein the data entry device is also mounted on the stand.

7. The system of claim 5, further comprising a sensor for detecting when the selectorized dumbbell is in a proper weight adjusting position on the stand, and wherein the sensor is operatively connected to the controller for inhibiting a weight adjustment operation unless the sensor reports to the controller that the selectorized dumbbell has been placed in the proper weight adjusting position on the stand.

8. The system of claim 5, further comprising a device configured to grip the selectorized dumbbell for retaining the selectorized dumbbell in the proper weight adjusting position on the stand during a weight adjustment operation.

9. The system of claim 8, wherein the gripping device comprises a plurality of fingers movably supported on the stand for movement between a first position in which the fingers are clear of the selectorized dumbbell and a second position in which the fingers overlie portions of the selectorized dumbbell to hold the selectorized dumbbell in place on the stand.

10. The system of claim 9, wherein the stand comprises an upper support surface on which the selectorized dumbbell is supported when the selectorized dumbbell is in the proper weight adjusting position, and wherein the fingers are pivotal relative to the upper support surface such that the fingers can be swung from the first position in which upper ends of the fingers are swung laterally outwardly of opposed sides of the selectorized dumbbell to the second position in which the upper ends of the fingers are swung laterally inwardly to overlie opposed sides of the selectorized dumbbell.

11. The system of claim 10, wherein the fingers project through slots in the upper support surface with the upper ends of the fingers being continuously located above the support surface as the fingers pivot between the first and second positions thereof.

12. The system of claim 1, further including a plurality of selectorized dumbbells of the type recited in claim 1, and wherein a single electric motor is operatively connected to the selectors of the plurality of selectorized dumbbells at least whenever a weight adjustment operation takes place such that only one motor adjusts the selectors of both dumbbells substantially simulataneously.

13. The system of claim 12, further comprising:

(a) a stand on which the plurality of selectorized dumbbells are supported during a weight adjustment operation;

(b) wherein the motor is mounted on the stand with the motor having a rotatable motor drive shaft;

(c) a plurality of rotatable drivers corresponding in number to the plurality of selectorized dumbbells on the stand with one driver being releasably connected to the selector of each dumbbell when each dumbbell is on the stand; and (d) a belt and pulley system connecting the motor drive shaft to the drivers for rotating the drivers substantially simultaneously with rotation of the motor drive shaft.

14. The system of claim 13, wherein the stand comprises an upper support surface on which the selectorized dumbbells are supported during a weight adjustment operation, and wherein the motor and belt and pulley system are mounted on the stand beneath the upper support surface with the rotatable drivers having access through holes in the upper support surface to the selectors of the selectorized dumbbells for coupling to the selectors.

15. The system of claim 1, further comprising:

(a) a stand on which the selectorized dumbbell is supported during a weight adjustment operation;

(b) wherein the motor is mounted on the stand; and (c) a driver releasably connected to the selector of the dumbbell when the dumbbell is on the stand with the driver being driven by the motor when the motor is energized.

16. The system of claim 1, wherein the motor is mounted on the handle of the selectorized dumbbell and is always operatively coupled to the selector.

17. The system of claim 16, further comprising:

(a) an electrically operated data entry device to allow the user to input the desired exercise weight;

(b) a controller operatively communicating with the data entry device and the electric motor for energizing the electric motor from the electric power source to cause the electric motor to move the selector to the adjustment position thereof that corresponds to the desired exercise weight input by the operator into the data entry device; and (c) wherein the data entry device and controller are also mounted on the handle of the selectorized dumbbell.

18. The system of claim 17, further comprising a battery mounted on the handle to serve as the electric power source.

19. A weight selection and adjustment system for a selectorized dumbbell, which comprises:

(a) a selectorized dumbbell, which comprises:

(i) a stack of nested left weight plates and a stack of nested right weight plates;

(ii) a handle having a left end and a right end; and (iii) a movable selector having a plurality of different adjustment positions in which the selector may be disposed, wherein the selector is configured to couple selected numbers of left weight plates to the left end of the handle and selected numbers of right weight plates to the right end of the handle with the selected numbers of coupled weight plates differing depending upon the adjustment position in which the selector is disposed, thereby allowing a user to select for use a desired exercise weight to be provided by the selectorized dumbbell; and (b) means selectively actuable by the user for adjusting the exercise weight of each dumbbell without requiring the user to physically contact and move the selector himself or herself.

20. A weight selection and adjustment system for a dumbbell, which comprises:

(a) a dumbbell that provides an exercise weight that is lifted by a user when the user grips and lifts a handle of the dumbbell, wherein the exercise weight provided by the dumbbell is adjustable by coupling more or fewer weight plates to each end of the handle;

(b) an electric motor that may be selectively energized and when energized will cause a desired number of weight plates to be coupled to each end of the handle; and (c) a data entry device to allow the user to input a weight selection decision that operatively controls the energization of the motor to adjust the exercise weight of the dumbbell in accordance with the weight selection decision input into the data entry device by the user.

* * * * *

UNITED STATES PATENT AND TRADEMARK OFFICE

CERTIFICATE OF CORRECTION

PATENT NO. : 7,578,771 B1
APPLICATION NO. : 11/999742
DATED : August 25, 2009
INVENTOR(S) : Carl K. Towley, III et al.

It is certified that error appears in the above-identified patent and that said Letters Patent is hereby corrected as shown below:

Col. 12, Line 20, change "claim 1" to --claim 2--.

Signed and Sealed this

First Day of December, 2009

David J. Kappos

David J. Kappos
*Director of the United States Patent and Trademark Office*